United States Patent [19]

Smetak

[11] Patent Number: 4,576,523

[45] Date of Patent: Mar. 18, 1986

[54] PILE RELEASE MECHANISM

[75] Inventor: Edward C. Smetak, Harvey, La.

[73] Assignee: Exxon Production Research Co., Houston, Tex.

[21] Appl. No.: 555,228

[22] Filed: Nov. 25, 1983

[51] Int. Cl.[4] ..... E02B 17/02; E02D 5/00

[52] U.S. Cl. ..... 405/227; 405/228

[58] Field of Search ..... 405/224, 227, 228, 232, 405/195, 231, 246, 247, 251

[56] References Cited

U.S. PATENT DOCUMENTS

| | | | |
|---|---|---|---|
| 1,581,442 | 4/1926 | Hawkins | 166/135 |
| 2,460,352 | 2/1949 | Jensen | 285/88 |
| 3,186,745 | 6/1965 | Lyles | 403/2 |
| 3,841,665 | 10/1974 | Capot | 285/2 |
| 4,322,182 | 3/1982 | Ostgaard | 405/227 |

*Primary Examiner*—David H. Corbin

*Attorney, Agent, or Firm*—John S. Schneider

[57] ABSTRACT

A mechanism for releasing a pre-installed pile attached to a pile guide connected to an offshore platform is supported in the pile and includes pile latch means rotatable from a latch position in which one end extends through an opening in the pile and engages the upper end of the pile guide to a retracted unlatched position in which the entire latch means is located within the pile. The inner end of the latch means is connected to a collapsible compression linkage assembly which when in one position maintains the latch means in its latch position and when moving from the one position to another collapsed position causes the latch means to rotate to its unlatched position within the pile. A slide plate capable of causing the linkage assembly to collapse when moving downwardly from a first position to a second position is releasably held in the first position by shearable means. The linkage assembly includes two pairs of linkage arms, one connecting latch pins to the inner end of the latch means and floating pins and the other connecting the floating pins to pivot pins. The slide plate contains inwardly slanting surfaces which engage the floating pins when the slide plate moves downwardly to move the floating pins outwardly and cause collapse of the linkage assembly. The slide plate is released from its first position and moves downwardly by the force of a follower which extends from the surface into the upper end of the pile and engages the upper end of the slide plate.

12 Claims, 10 Drawing Figures

PILE RELEASE MECHANISM

BACKGROUND OF THE INVENTION

The present invention concerns a pile release mechanism for holding pre-installed piles in place on an offshore platform during launching and upending of the platform and for remotely releasing the piles once the offshore platform has been positioned in its final location on the sea floor.

Most offshore platforms, e.g., those used in oil/gas drilling and producing operations, require some form of skirt piles at their bases to add stability to the platform by resisting lateral foundation loads. The installation of such piles requires (1) diver assistance once the offshore platform has been launched, upended, and positioned on the sea floor or (2) an underwater release mechanism when such piles have been pre-installed, i.e., piles attached to the platform before the platform is launched, upended, and positioned on the sea floor.

In the past, two concepts have been generally employed to release pre-installed piling. The first concept is a friction clamp which depends on friction generated by a clamp band to lock the pile to the offshore platform. The variability associated with friction forces and the tension in the clamp band cause reliability of the clamp to be questionable. The second concept consists of connections between the pile and the offshore platform which are shearable by a blow from a hammer. High capacity shear connections are quite variable and may fail prematurely or be difficult to break.

The pile release mechanism of the present invention eliminates the concerns associated with those previous concepts. The mechanism is simple, dependable, and well suited for deep water applications where diver assistance is not desirable.

SUMMARY OF THE INVENTION

The release mechanism in accordance with the invention uses the known concept of collapsing two-member compression linkage to release protruding latch members constructed as levers to increase mechanical advantage. That concept is uniquely applied to solve the pile release problem. The release mechanism is assembled into the interior of a pile where the mechanism is protected during platform launch, upending, and positioning. The apparatus is designed to releasably connect a pre-installed pile to a pile guide which surrounds the upper end of the pile and is connected to an offshore platform. Such apparatus comprises a pile release latch mechanism arranged within the pile including latch support means connected to the pile, a slide plate movable from an upper to a lower position, shearable means releasably connecting the slide plate to the latch support means when the slide plate is in the upper position thereof, a pair of pile latches capable of extending from and retracting into the pile, the pile latches latching onto the pile guide when extended from the pile, and collapsible compression linkage means connecting the pile latches to the latch support means, the slide plate engaging the linkage means when moving from the upper to the lower position thereof to cause the linkage means to collapse and the pile latches to move from the extended to the retracted positions thereof.

A follower string, assembled at the surface and lowered through guides on the platform, is landed on the upper end of the slide plate to shear the shearable means and allow the slide plate to move downward. Center pins in the compression linkage means are forced outward by the slide plate allowing the compression linkages to collapse. As the linkages collapse the pile latches retract into the pile thereby allowing the pile to release from the surrounding pile guide. After the pile has penetrated into the sea floor under its own weight, the follower string is landed on the upper end of the pile. Further penetration results under the added weight of the follower string. A hammer is then placed on the top of the follower string to drive the pile to final penetration after which the follower string is retrieved to the surface.

DESCRIPTION OF THE PREFERRED EMBODIMENTS

Figure 1:
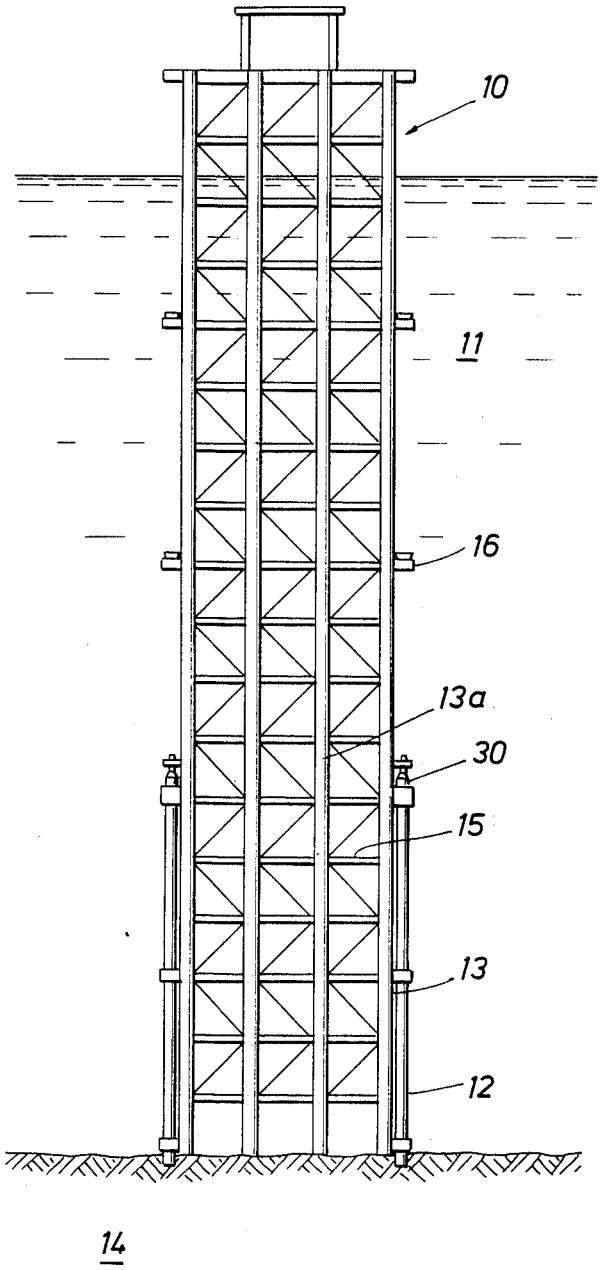
FIG. 1 is a schematic view of an offshore platform with pre-installed piles.

An offshore platform, generally designated 10, such as used in the drilling and production of offshore oil and/or gas wells, is shown in FIG. 1 installed in a body of water 11. A number of pre-installed skirt piles 12 are releasably connected to outer legs 13 of platform 10 by a pile release mechanism 30. Legs 13 and other legs **13*a* of platform 10 are interconnected by crossbracing supports 15. Spaced apart pile guides 16 are shown attached to legs 13**.

Figure 2:
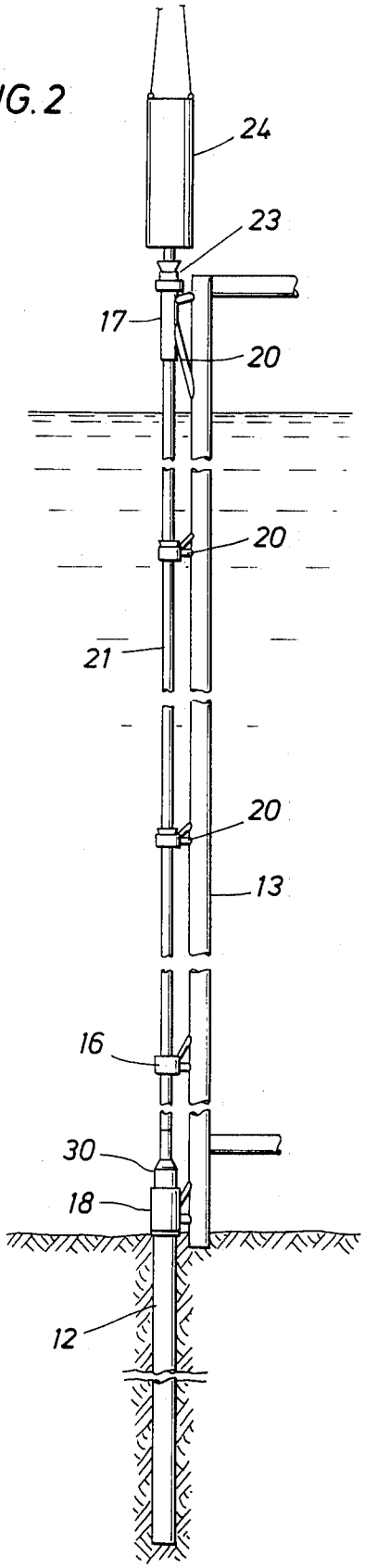
FIG. 2 is a schematic view of one of the jacket legs of the offshore platform connected to one of the piles and of the pile follower string and hammer.

Referring also to FIG. 2 each pile guide 16 and the upper pile guide sleeve 17 and mudline pile guide 18 are attached to each leg 13 by means of struts/brackets 20. A follower string 21, which may contain several sections of pipe, extends from the upper end of skirt pile 12 through pile guides 16 and upper pile sleeve guide 17 and an external spider 23 to engagement with a driving head or hammer 24 at the upper end of the platform.

The latch mechanism 30 is illustrated in FIGS. 3 through 9. As shown therein, the latch mechanism is arranged within the upper end of pile 12 in which opposing windows or openings 31 are formed. Pile 12 narrows at its uppermost end **12*a* to approximately the diameter of follower 21. Two pile lugs or latches 33 extend through the openings 31 in pile 12 in the latch positions shown in FIGS. 3 and 9*a* and rest on the upper end of guide 18 to support pile 12 on guide 18. Each pile latch 33 rotates on a latch support pin 35 which, in turn, is attached to and supported on a side support bracket 36 welded to the interior surface of pile 12. An upper support frame member 36*a*** and a lower support frame 36*b* are connected to support brackets 36. The inner end of each pile latch 33 is attached to a latch pin 38 which is part of a linkage assembly designated 40. That assembly also includes compression linkage arms 41 and 42 and floating pins 43 and pivot pins 44. Each linkage arm 41 is attached to a latch pin 38 and a floating pin 43 and each linkage arm 42 is attached to a floating pin 43 and a pivot pin 44. The latter is attached to the lower support frame member 37 which is connected to frame member 36*b*. A slide plate 45, which includes two vertically extending spaced apart members 45*a* and 45*b* connected together by horizontally extending members 45*c* (top), 45*d* (intermediate) and 45*e* (bottom) and provided with stiffeners 50, is initially secured to lower support frame 36*b* by shear pins 46. Each slide plate member 45*a* and 45*b* is formed with an inwardly slanted surface 47 and a u-shaped slot 48 on each side of stiffener 50. Floating pins 43 are located in the u-shaped slots when slide plate members 45*a* and 45*b* are in their initial pinned positions.

Figure 3:
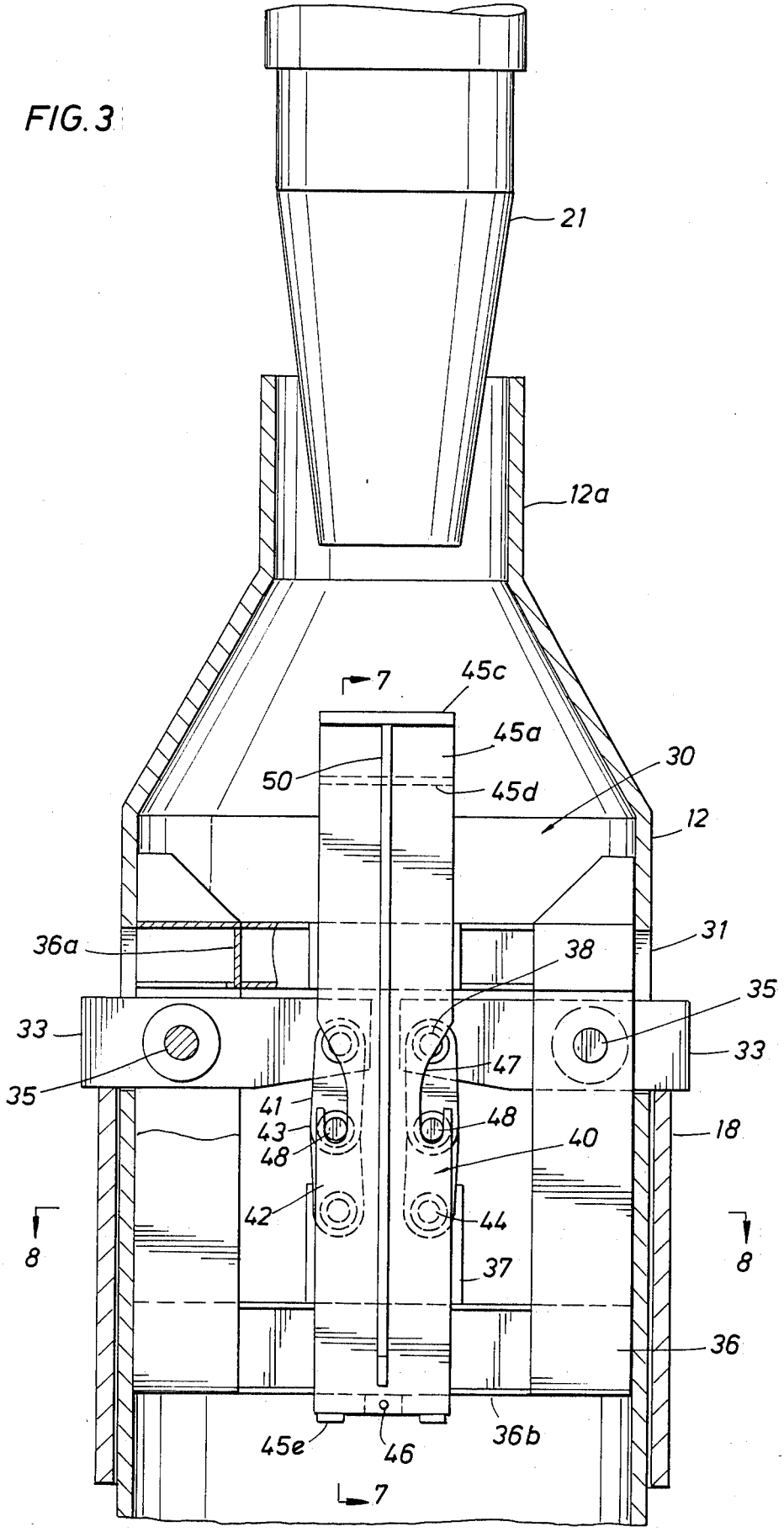
FIG. 3 is an elevation of the pile release mechanism arranged in the pile and latched to the surrounding pile guide with the follower shown above the pile.
Figure 4:
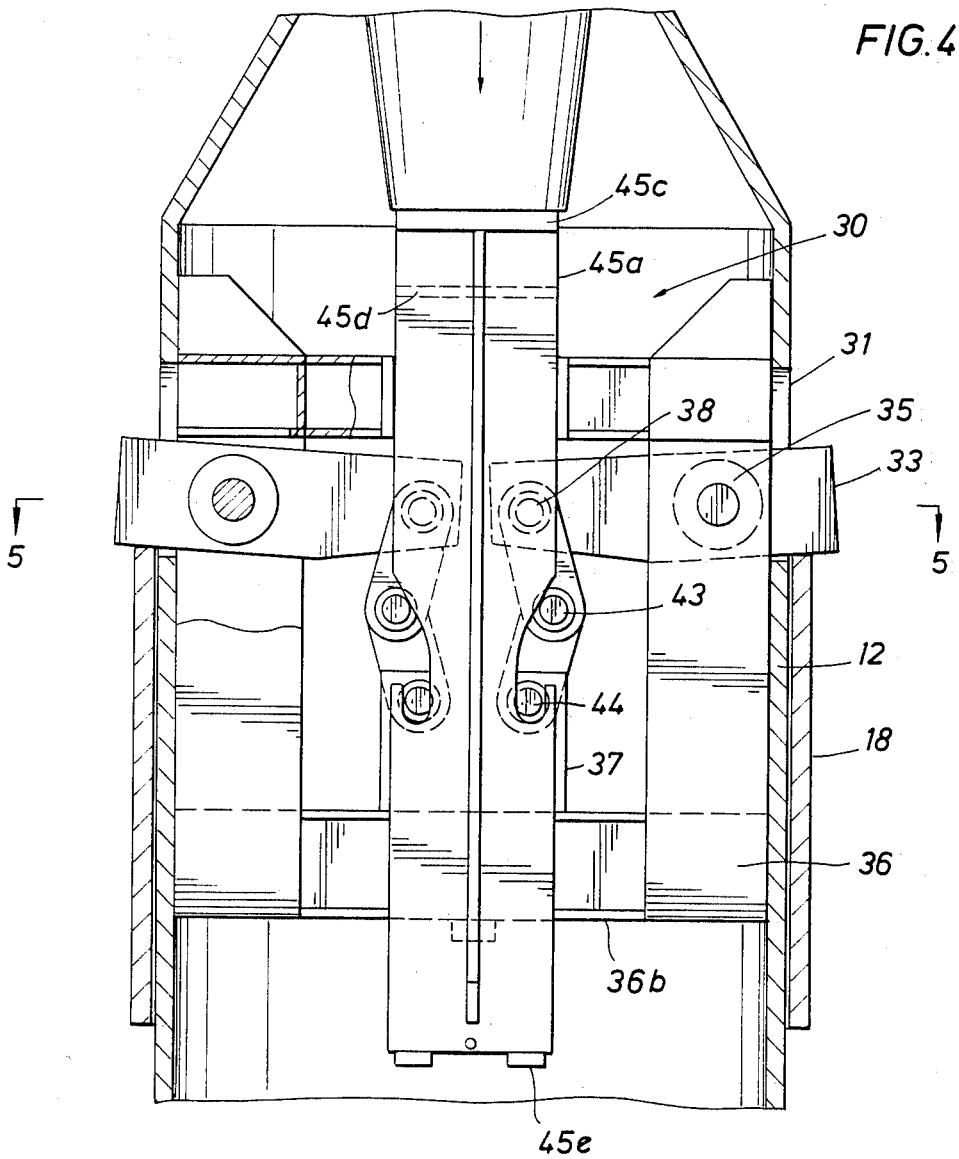
FIG. 4 is a view similar to that of FIG. 3 with the follower in engagement with the release mechanism and the linkages beginning to collapse and the latch beginning to retract.
Figure 5:
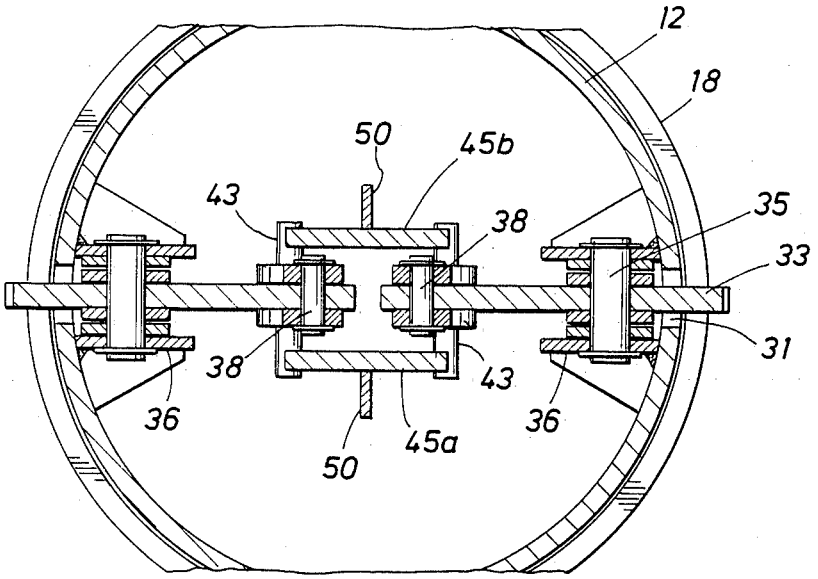
FIG. 5 is a view taken on lines 5—5 of FIG. 4.
Figure 6:
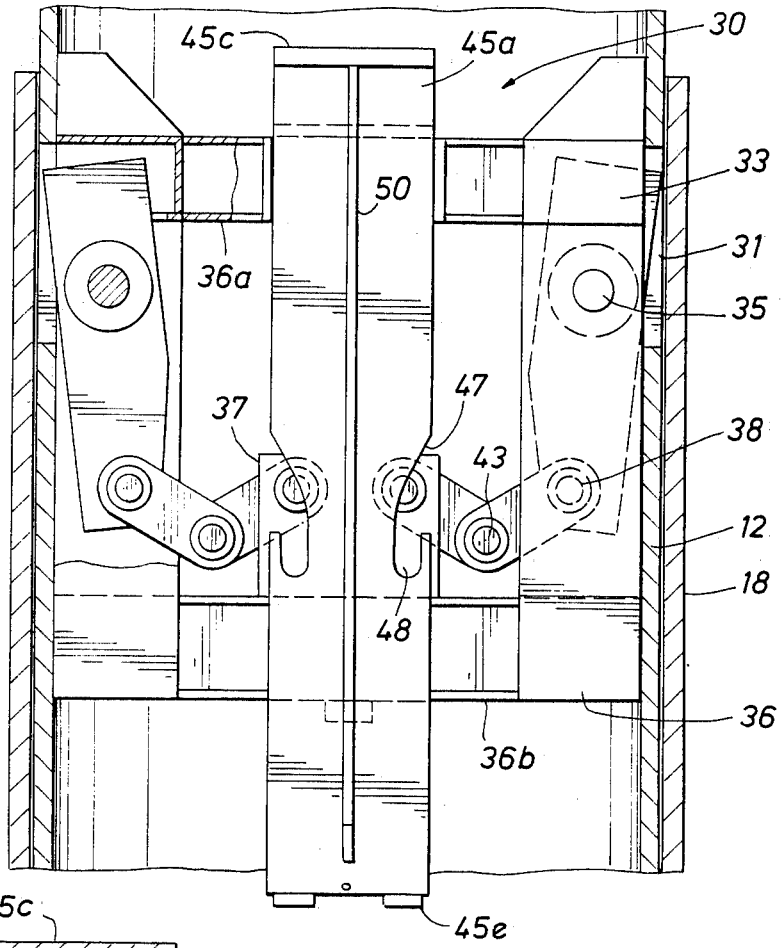
FIG. 6 is a view similar to that of FIGS. 3 and 4 with the linkage completely collapsed and the latches completely retracted.
Figure 7:
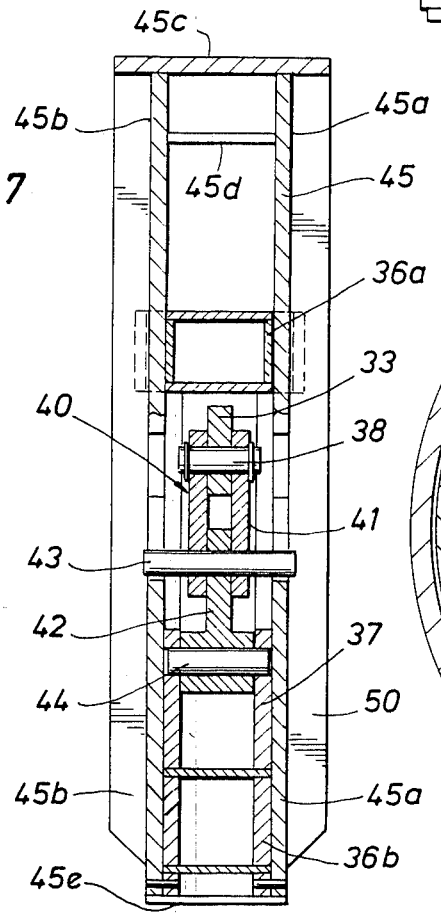
FIG. 7 is a view taken on lines 7—7 of FIG. 3.
Figure 8:
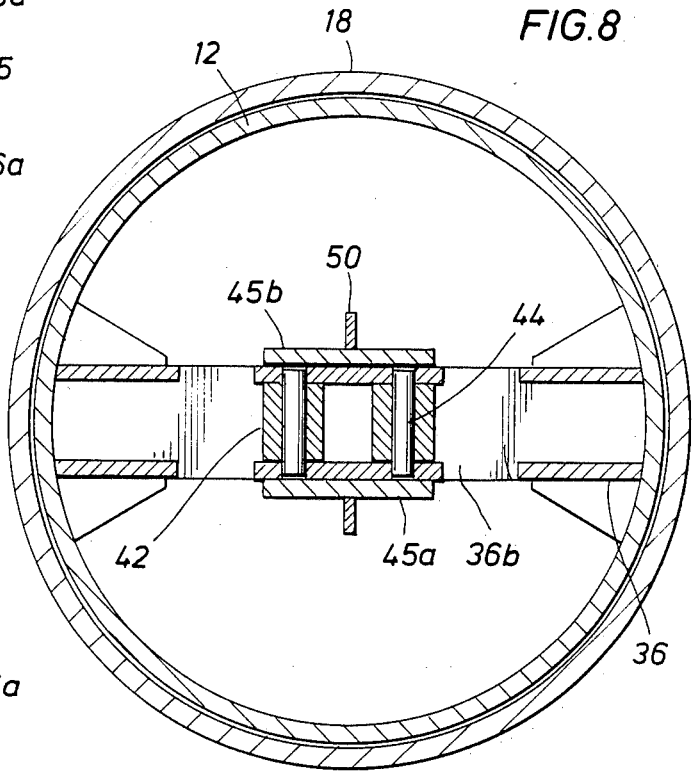
FIG. 8 is a view taken on lines 8—8 of FIG. 3.
Figure 9A:
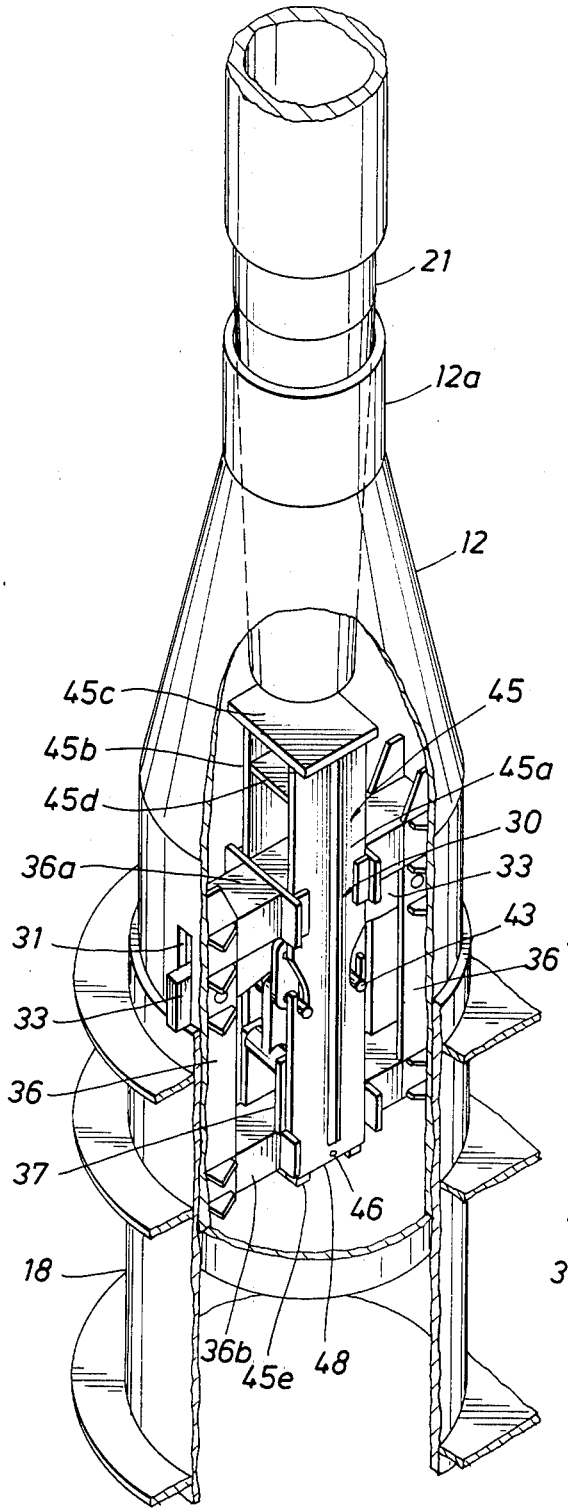
FIG. 9A and 9B are isometric views, respectively, of the release mechanism engaged and disengaged.
Figure 9B:
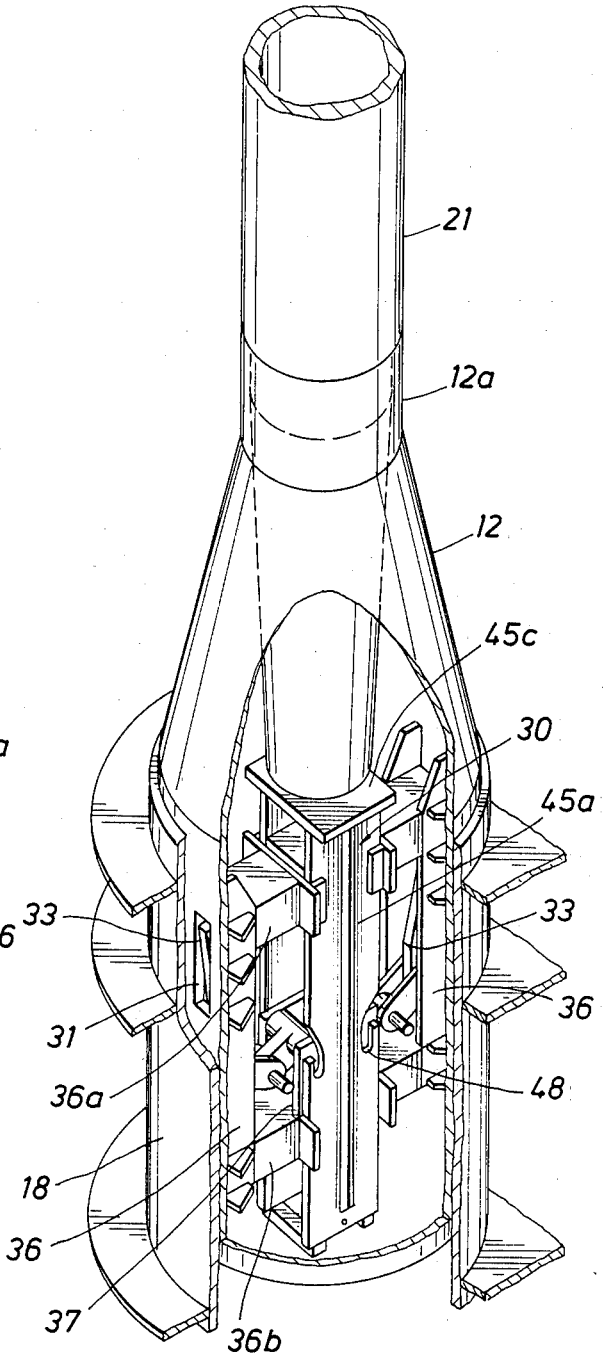

Platform 10 with the pre-installed piles 12, is erected offshore in water 11 as shown in FIG. 1. Piles 12 are supported on guide sleeves 18 by means of latches 33 as shown in FIGS. 3 and 9A. When it is desired to release pile 12 from supporting guide 18 follower 21 is lowered through guides 16 on jacket leg 13. When follower 21 engages the upper end 45*c* of slide plate 45 as shown in FIG. 4, shear pins 46 connecting slide plate members 45*a* and 45*b* to lower support member 36*b* shear under the weight of the follower causing slide plate 45 to move downwardly forcing linkage assembly 40 to collapse. In the downward movement of slide plate 45 each slanted surface 47 engages a floating pin 43 causing those pins to move outwardly as shown in FIG. 4. That action, in turn, causes the inner ends of pile latches 33 to rotate on latch support pins 35 and latch pins 38 to swing downwardly and outwardly to the completely unlatched positions of pile latches 33 shown in FIGS. 6 and 9B. In such positions the outer ends of pile latches 33 are located entirely within the confines of pile 12 and pile 12 is release from its supporting guide 18. Upon release pile 12 penetrates into the sea floor under its own weight. Then follower string 21 is landed on the upper end of pile 12 and further penetration of pile 12 results from the added weight of the follower string. Hammer 24 is then placed on top of follower string 21 as shown in FIG. 2 and pile 12 is driven to final penetration. Follower string 21 is then retrieved to the surface.

Various modifications may be made in the described pile release mechanism without departing from the scope of the invention as defined in the attached claims.

I claim:

1. Apparatus , capable of releasing under load, for releasably connecting a pre-installed pile to a pile guide connected to an offshore platform and surrounding the upper end of said pile, said pile having an opening adjacent the upper end of said pile guide comprising:

a pile releasable latch mechanism supported in said pile including:

latch support means mounted in said pile;

latch support pins arranged on said latch support means;

a pair of latches rotatable on said latch support pins from a latch position in which one end of each of said latches extends through said opening in said pile to latch onto the upper end of said pile guide to an unlatched position in which said latches are retracted to positions within said pile;

a pile latch assembly connected to each of the other ends of said latches and supported on said latch support means capable of collapsing to move said latches from their extended latch positions to their retracted unlatched positions;

a slide plate capable of moving downwardly from a first to a second position releasably retainable on said latch support means in said first position; and means on said slide plate capable of engaging said pile latch assembly cause said linkage means to collapse when said slide plate moves from its first to its second position.

2. Apparatus as recited in claim 1 including shearable means releasably retaining said slide plate in said first position thereof.

3. Apparatus as recited in claim 2 in which said pile latch assembly comprises two pairs of linkage arms, latch pins, floating pins, and pivot pins, said pivot pins being immovably attached to said latch support means;

one pair of said linkage arms connecting said latch pins and said floating pins and the other pair of said linkage arms connecting said floating pins and said pivot pins;

said latch pins connecting said one pair of linkage arms to the other ends of said latches, movement of said floating pins outwardly causing said latch pins and the inner ends of said latches to move downwardly and outwardly rotating said latches on said latch support pins from their extended to their retracted positions.

4. Apparatus as recited in claim 3 including slanted surfaces on said slide plate engaging said floating pins when said slide plate moves from its first to its second position to cause said floating pins to move outwardly.

5. Apparatus as recited in claim 4 wherein said shearable means comprises a shear pin connecting said slide plate to said latch support means capable of shearing when a selected force is applied to the upper end of said slide plate.

6. Apparatus, capable of releasing under load, for releasably connecting substantially vertically-extending elongated inner and outer members, said inner member having an opening through the wall thereof adjacent the upper end of said outer member comprising:

a releasable latch mechanism secured within said inner member including:

latches movable from a latch position in which said latches extend through said opening in said inner member to latch onto the upper end of said outer member to an unlatched position in which said latches are retracted to positions within said inner member;

a pile latch assembly connected to said latches capable of collapsing to move said latches from their extended latch positions to their retracted unlatched positions; and means capable of engaging said pile latch assembly to cause said pile latch assembly to collapse.

7. Apparatus as recited in claim 6 in which said releasable latch mechanism includes latch support means mounted in said inner member and said means causing collapse of said pile latch assembly includes a slide plate capable of moving downwardly from a first to a second position and means releasably retaining said slide plate on said latch support means in said first position.

8. Apparatus as recited in claim 7 in which said means releasably retaining said slide plate comprises shearable means.

9. Apparatus as recited in claim 8 in which said pile latch assembly comprises two pairs of linkage arms, latch pins, floating pins, and pivot pins, said pivot pins being immovably attached to said latch support means;

one pair of said linkage arms connecting said latch pins and said floating pins and the other pair of said linkage arms connecting said floating pins and said pivot pins;

said latch pins connecting said one pair of linkage arms to said latches, movement of said floating pins outwardly causing said latch pins to move downwardly and outwardly moving said latches from their extended to their retracted positions.

10. Apparatus as recited in claim 9 including slanted surfaces on said slide plate engaging said floating pins when said slide plate moves from its first to its second position to cause said floating pins to move outwardly.

11. Apparatus as recited in claim 10 wherein said shearable means comprises a shear pin connecting said slide plate to said latch support means capable of shearing when a selected force is applied to the upper end of said slide plate.

12. A method for securing an offshore platform to the sea floor comprising:

securing a pile release mechanism in the interior of a pile pre-installed on said offshore platform and releasably connected to a pile guide surrounding the upper end of the pile and connected to said offshore platform;

applying a force to said pile release mechanism to cause said pile release mechanism to collapse compression linkage in said pile release mechanism and retract latches connecting said pile to said pile guide when extended to release said pile from said pile guide;

said released pile penetrating said sea floor under its own weight;

landing a follower string on the upper end of said pile;

hammering the top of the follower string to drive said pile to final penetration; and then retrieving said follower string to the surface of the sea.

* * * * *